US005601637A

United States Patent [19]

Wachi et al.

[11] Patent Number: 5,601,637

[45] Date of Patent: Feb. 11, 1997

[54] ELECTROLESS GOLD PLATING SOLUTION

[75] Inventors: Hiroshi Wachi, Kanagawa-ken; Yutaka Otani, Hiratsuka, both of Japan

[73] Assignee: Electroplating Engineers of Japan, Limited, Tokyo, Japan

[21] Appl. No.: 514,721

[22] Filed: Aug. 14, 1995

[30] Foreign Application Priority Data

Aug. 19, 1994 [JP] Japan ..... 6-195349

[51] Int. Cl.[6] ..... C23C 18/52

[52] U.S. Cl. ..... 106/1.23; 106/1.26

[58] Field of Search ..... 106/1.23, 1.26

[56] References Cited

U.S. PATENT DOCUMENTS

| | | | |
|---|---|---|---|
| 4,188,234 | 10/1978 | Jans | 106/1.26 |
| 4,337,091 | 6/1982 | El-Shazly et al. | 106/1.23 |
| 5,130,168 | 7/1992 | Mathe et al. | 106/1.23 |
| 5,258,062 | 11/1993 | Nakazawa et al. | 106/1.23 |
| 5,277,790 | 1/1994 | Morrissey | 106/1.26 |
| 5,338,343 | 8/1994 | Kroll et al. | 106/1.23 |

FOREIGN PATENT DOCUMENTS

| | | |
|---|---|---|
| 52-124428 | 10/1977 | Japan . |
| 55-24914 | 2/1980 | Japan . |
| 56-152958 | 11/1981 | Japan . |
| 59-229478 | 12/1984 | Japan . |
| 60-121274 | 6/1985 | Japan . |
| 61-279685A | 12/1986 | Japan . |
| 62-99477 | 5/1987 | Japan . |
| 63-262482A | 10/1988 | Japan . |
| 3-02471 | 3/1991 | Japan . |
| 2225026 | 5/1990 | United Kingdom . |

OTHER PUBLICATIONS

European Search Report, for EP95305653.8 (2 pages).

*Primary Examiner*—Helene Klemanski

*Attorney, Agent, or Firm*— Watov & Kipnes, P.C.

[57] ABSTRACT

The present invention provides an electroless gold plating solution which offers deposition layers exactly onto predetermined areas on the surface of the workpiece, without undesirable spread of plated areas. The electroless gold plating solution according to the invention contains 5–500 mg/l, or preferably 10–100 mg/l, or sodium nitrobenzenesulfonate and/or p-nitrobenzoic acid as a reduction inhibitor.

9 Claims, No Drawings

ELECTROLESS GOLD PLATING SOLUTION

BACKGROUND OF THE INVENTION (1) Field of the Invention

The invention relates to an electroless gold plating solution, particularly a solution capable of plating exactly onto predetermined parts on the workpiece.

(2) Description of the Prior Art

An electroless gold plating solution contains a reducing agent, such as boron potassium hydride or boron sodium hydride, which causes gold deposit onto the workpiece, as disclosed, for example, in the Japanese laid open patent No. 52-124428 or No. 55-24914.

Such conventional plating solutions contain a relatively large amount of a reducing agent to assure high deposition rates, which may, however, lead to excessive reduction of gold by which gold deposits onto unwanted parts of the workpiece, for example outside a metalized part. This may result in undesired electrical connections between separate plated parts arranged at a short distance.

The present invention aims at elimination of such problems associated with conventional plating solutions, and provides an electroless gold plating solution from which gold deposits exactly onto desired parts of the workpiece without undesirable spread of the plated area.

SUMMARY OF THE INVENTION

The electroless gold plating solution according to the invention contains 5–500 mg/l, or preferably 10–100 mg/l, of sodium nitrobenzensulfonate (NBS hereinafter) and/or p-nitrobenzoic acid (PNBA hereinafter) to control the reduction rate of gold. These substances do not effectively control metal deposition at a concentration less than 5 mg/l, while lowering the deposition rate at more than 500 mg/l.

Addition of NBS and/or PNBA, being an oxidizing agent, controls the action of the reducing agent to make gold deposit only onto desired portions of the workpiece, without lowering the deposition rate excessively.

The electroless gold plating solution according to the invention contains gold in a form of an alkali metal gold cyanide, such as potassium gold cyanide or sodium gold cyanide, the former being the preferred form. A preferable concentration range of gold is 0.5–8 g/l (as Au metal).

As the reducing agent are used boron-based substances, such as dimethylamineborane, boron potassium hydride, or boron sodium hydride. A preferable concentration range of the reducing agent is 1–30 g/l.

The electroless gold plating solution according to the invention may, in addition, contain an alkali metal cyanide, specifically sodium cyanide or potassium cyanide, when the stability of the self-catalyzing process is especially needed. A preferable concentration range of such an alkali metal cyanide is 0.1–10 g/l.

Further, 0.1–50 ppm thallium compound and/or lead compound may be added to the plating solution as an additive metal so as to raise a deposit rate. As to the thallium compound to be added, thallium formate, thallium sulfate, thallium oxide, thallium malonate, thallium chloride, etc. are preferably applied. The thallium formate is particularly feasible to use because of having a lower toxicity than the thallium sulfate, etc. As to the lead compound, lead citrate, lead acetate, lead oxide, etc. are preferably applied.

Along with the thallium and/or lead compounds mentioned above, the solution may contain 0.1–10 g/l, or preferably 0.5–2 g/l, of a chelating agent, such as diethylenetriaminepentaacetic acid, ethyle nediaminetetraacetic acid, or nitrilotriacetic acid, the first being a preferable agent. Such a chelating agent acting as a complexing agent prevents precipitation of gold even at high concentrations of the thallium or lead compound mentioned above, thus allowing addition of a less restricted amount of such a metal compound to the plating solution.

The pH value of the solution should preferably be kept in a range from 11 to 14. An alkali metal hydroxide, such as sodium hydroxide or potassium hydroxide is used as a pH adjustor to maintain such pH level.

Plating operations using the solution should preferably performed at a temperature of 50°–80° C.

It should be noted that the content of the invention is not limited to the above description, and the objects, advantages, features, and usages will become more apparent according to descriptions below. It is also to be understood that any appropriate changes without departing from the spirit of the invention are in the scope of the invention.

DETAILED DESCRIPTION OF THE PREFERRED EMBODIMENTS

Embodiments of the present invention will be described hereinafter.

First Embodiment

TABLE 1

| | |
|---|---|
| Potassium gold cyanide | 4 g/l as gold |
| Dimethylamineborane | 8 g/l |
| Thallium formate | 10 ppm as thallium |
| Nitrilotriacetic acid | 2 g/l |
| Potassium hydroxide | 35 g/l |
| Potassium cyanide | 2 g/l |

TABLE 2

| | |
|---|---|
| Temperature | 70° C. |
| pH | 14 |
| Plating time | 30 min. |

Various amounts of NBS were added to an electroless gold plating solution of the composition presented above prepared using guaranteed reagents. The deposits obtained were evaluated. The evaluation was performed for checking to see the portions to be plated have no deposit squeezed out, and on the deposition rate. A pair of metalized parts at a distance of 100 μm were formed on the workpiece, onto which gold was deposited using the solution above, and the electrical connection between the two gold-plated parts were checked. The plating was performed until the thickness of the deposited layer reached 2 μm, and the deposition rates were measured. Deposits obtained had a uniform lemon-yellow color and presented no problem in the appearance.

TABLE 3

| | No. | NBS additives (mg/l) | Evaluation | Deposition rate (μm/hr) |
|---|---|---|---|---|
| Examples | 1 | 5 | ○ | 4.3 |
| | 2 | 25 | ○ | 4.3 |
| | 3 | 100 | ○ | 3.8 |
| | 4 | 200 | ○ | 3.4 |

TABLE 3-continued

| No. | | NBS additives (mg/l) | Evaluation | Deposition rate (μm/hr) |
|---|---|---|---|---|
| | 5 | 500 | ○ | 3.0 |
| | 6 | 1000 | ○ | 1.8 |
| Comparative Example | 7 | — | × | 4.3 |

Evaluation
○: No continuity between gold-plated parts.
×: Continuity between gold-plated parts.

As the results shown in Table 3 indicate, in the Examples wherein the solutions contain NBS, only the interior of the metalized parts are gold-plated, thereby giving no continuity between the gold-plated parts abutting each other. While the solution used in the Reference Example without NBS resulted in an electrical continuity between the metalized parts abutting each other, because gold deposited also outside the metalized parts on the surface of the workpiece. The addition of NBS did not lead to any excessive decrease in deposition rate in comparison with non-addition of NBS.

Second Embodiment

TABLE 4

| | |
|---|---|
| Potassium gold cyanide | 4 g/l as gold |
| Boron potassium hydride | 20 g/l |
| Thallium formate | 10 ppm as thallium |
| Nitrilotriacetic acid | 2 g/l |
| Potassium hydroxide | 10 g/l |
| Potassium cyanide | 2 g/l |

TABLE 5

| | |
|---|---|
| Temperature | 70° C. |
| pH | 13 |
| Plating time | 30 min. |

In this example where boron potassium hydride was used as the reducing agent, addition of 5–500 mg/l of NBS led to results similar to those in Example 1 above.

The electroless gold plating solution according to the invention, as described above, offers deposition layers exactly onto predetermined areas on the surface of the workpiece, without undesirable spread of plated areas, and is therefore well suited for plating onto very small areas.

What is claimed is:

1. An electroless gold plating solution containing gold as a gold alkali metal cyanide, a boron-based reducing agent, and an alkali metal hydroxide as a pH adjustor, wherein 5–99 mg/l of sodium nitrobenzenesulfonate, p-nitrobenzoic acid or mixtures thereof are added.

2. An electroless gold plating solution as defined in claim 1 wherein the boron-based reducing agent contains at least one of dimethylamineborane, boron potassium hydride, and boron sodium hydride.

3. An electroless gold plating solution as defined in claim 1 wherein the concentration of the reducing agent is 1 to 30 g/l.

4. An electroless gold plating solution as defined in claim 2 wherein the concentration of the reducing agent is 1 to 30 g/l.

5. An electroless gold plating solution as defined in claim 1, which has a pH value of 11 to 14.

6. An electroless gold plating solution as defined in claim 2, which has a pH value of 11 to 14.

7. An electroless gold plating solution as defined in claim 3, which has a pH value of 11 to 14.

8. An electroless gold plating solution as defined in claim 4, which has a pH value of 11 to 14.

9. An electroless gold plating solution as defined in claim 1, which contains alkali metal cyanide.

* * * * *